US008257202B1

(12) United States Patent
Stanek

(10) Patent No.: US 8,257,202 B1
(45) Date of Patent: Sep. 4, 2012

(54) ADJUSTABLE BATTING PRACTICE TEE

(76) Inventor: Jeffrey A. Stanek, Patton, PA (US)

( * ) Notice: Subject to any disclaimer, the term of this patent is extended or adjusted under 35 U.S.C. 154(b) by 22 days.

(21) Appl. No.: 12/775,801

(22) Filed: May 7, 2010

(51) Int. Cl.
*A63B 71/00* (2006.01)
*A63B 69/00* (2006.01)

(52) U.S. Cl. ..... 473/417; 473/422

(58) Field of Classification Search ..... 473/417, 473/422, 451, 431; D21/780, 715, 717
See application file for complete search history.

(56) References Cited

U.S. PATENT DOCUMENTS

| | | | | |
|---|---|---|---|---|
| 3,139,282 | A * | 6/1964 | Lande | 473/417 |
| 3,489,411 | A * | 1/1970 | Morelli et al. | 473/417 |
| 3,883,138 | A * | 5/1975 | Chorey | 473/417 |
| 4,456,250 | A * | 6/1984 | Perrone, Jr. | 473/417 |
| 4,664,374 | A | 5/1987 | Groves | |
| 4,819,937 | A | 4/1989 | Gordon | |
| 4,962,924 | A * | 10/1990 | James | 473/417 |
| 4,979,741 | A * | 12/1990 | Butcher | 473/417 |
| 5,004,234 | A | 4/1991 | Hollis | |
| 5,076,580 | A | 12/1991 | Lang | |
| 5,106,085 | A * | 4/1992 | Lewy | 473/417 |
| 5,536,004 | A * | 7/1996 | Wiseman et al. | 473/417 |
| 5,580,047 | A | 12/1996 | Shih et al. | |
| 5,595,384 | A | 1/1997 | Hardison, Jr. | |
| 5,662,536 | A | 9/1997 | Martinez | |
| 5,893,806 | A * | 4/1999 | Martinez | 473/447 |
| 5,928,092 | A | 7/1999 | Keeter et al. | |
| 6,238,307 | B1 * | 5/2001 | Owen | 473/417 |
| 6,413,175 | B1 * | 7/2002 | Mooney, Jr. | 473/417 |
| 6,461,255 | B1 | 10/2002 | Smith | |
| 6,551,204 | B1 * | 4/2003 | Di Re | 473/417 |
| 6,666,781 | B1 * | 12/2003 | Illis | 473/453 |
| 6,682,445 | B1 | 1/2004 | Tanner | |
| D514,638 | S | 2/2006 | deGrasse | |
| 7,063,632 | B2 * | 6/2006 | Green | 473/417 |
| 7,479,074 | B1 * | 1/2009 | Pierce | 473/417 |
| 2005/0143196 | A1 * | 6/2005 | Tsai | 473/417 |
| 2008/0085787 | A1 * | 4/2008 | Molloy et al. | 473/417 |

OTHER PUBLICATIONS

Tanner Baseball and Softball Batting Tee. Joe H. Tanner Baseball Products. http://www.tannertees.com/ Accessed May 28, 2009.

* cited by examiner

*Primary Examiner* — Mitra Aryanpour
(74) *Attorney, Agent, or Firm* — Montgomery Patent & Design, LLC; Robert C. Montgomery; Joseph Yaksich

(57) ABSTRACT

A teaching aid device that helps baseball players learn how to properly swing and hit a ball includes a pair of batting tees placed in a linear pattern parallel to the bat swing. The batter contacts one ball and then the other during one swing. With balls on both tees and the tees at the same height, the hitter is aligned to hit the back or rear baseball up the middle. By hitting the rear ball, and then extending through contact and hitting the front ball, the hitter teaches him or herself to "get extension" through the baseball. If the hitter does not hit the front ball squarely, the device will indicate that he or she does not "follow through". If the hitter hits the back ball only, this device provides instant feedback that the swing is not level.

14 Claims, 8 Drawing Sheets

ADJUSTABLE BATTING PRACTICE TEE

RELATED APPLICATIONS

The present invention was first described in a notarized Official Record of Invention on Mar. 23, 2009, that is on file at the offices of Montgomery Patent and Design, LLC, the entire disclosures of which are incorporated herein by reference.

FIELD OF THE INVENTION

The present invention relates generally to the game of baseball, and in particular, to an adjustable tee assembly adapted for practice in proper hitting techniques for the game of baseball.

BACKGROUND OF THE INVENTION

Baseball is an extremely popular pastime the world over. One (1) of the most fundamental and important aspects of the game of baseball is the ability to properly and confidently strike the ball while batting. Posture, motion, angle, height, reaction, and positioning are all critical aspects of proper hitting technique.

While the practice of hitting pitches is a common way to learn the game of baseball, this method provides little feedback to a user regarding their technique. It is difficult to assess and correct problems with hitting posture and technique in such a fast paced situation. Furthermore, it is difficult for a single user to accurately assess their own technique due to lack of perspective and difficulty in concentrating on self-evaluation during the fast paced activity of batting. In addition, consistency in foot placement, technique, bat angle, and the like is generally considered to be paramount to achieving proper form and can be difficult to estimate at the high speeds involved in normal batting practices.

Various attempts have been made to provide devices which help to train a user in batting technique. Examples of these attempts can be seen by reference to several U.S. patents. U.S. Pat. No. 4,664,374, issued in the name of Groves, describes an adjustable practice batting tee which allows a user to selectively vary and lock the position of the tee.

U.S. Pat. No. 5,076,580, issued in the name of Lang, describes a foot position teaching apparatus which provides an adjustable and lockable mechanism for helping a user to achieve consistent foot placement during batting practice.

U.S. Pat. No. 5,595,384, issued in the name of Hardison, Jr., describes a bat swing guide with an arcuate guide member attached to a vertical support in order to provide rigid resistance and a guiding function to a user during batting motions.

While these devices fulfill their respective, particular objectives, each of these references suffer from one (1) or more of the aforementioned disadvantages. Many such devices are not fully and easily adjustable for various users. Also, many such devices do not provide for a number of different configurations capable of teaching various aspects of batting technique. Furthermore, many such devices do not provide any means for training a user with regards to bat positioning during swing including parallel motioning, angle relative to the tee, height of swing, and the like. Accordingly, there exists a need for an adjustable batting practice tee without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to train a user in a variety of aspects related to the motion of batting including correct swing height, correct angle, parallel motioning, following through, and the like. Thus, the object of the present invention is to solve the aforementioned disadvantages and provide for this need.

To achieve the above objectives, it is an object of the present invention to provide a device and method that assist a user in learning proper swinging techniques for baseball, softball, and the like. The device comprises a base, two (2) adjustable tees, and two (2) ball holders.

Another object of the present invention is to provide conventional tee functionality by constructing each ball holder of a durable rubberized material in a cupped configuration which is capable of supporting a conventional baseball or the like and withstanding repeated impact from baseball bats and the like.

Yet still another object of the present invention is to prevent wobbling, swinging, and other undesirable motion of the tees during use by comprising the base of a planar surface in contact with a ground surface which provides support to the tees.

Yet still another object of the present invention is to aid a user in learning how to properly contact a ball by comprising a pair of tees in a linear pattern perpendicular to the facing direction of the batter. This allows a user check whether simultaneous contact is made with both tees in order to determine if the swinging motion was parallel at the point of contact.

Yet still another object of the present invention is to provide variable training configurations and heights for a variety of exercises and users of varying heights. Each tee comprises a pair of cylindrical telescoping members such that the second member is vertically slidably movable in relation to the first.

Yet still another object of the present invention is to allow a user to adjustably raise or lower each tee to a desired height and temporarily lock and stabilize the tee in position. Each tee comprises a plurality of apertures and a projection pin which engages the apertures in order to fix the telescoping members in a desired position relative to each other.

Yet still another object of the present invention is to provide a user with visual designations of the height between the ball holders and a ground surface based upon a chosen locking aperture by comprising markings or the like along the telescoping members.

Yet still another object of the present invention is to allow a user to selectively adjust the distance between the two tees via a slot in the base which allows sliding motion of the first telescoping member of each tee. The slot further comprises interior ridges which provide discrete adjustment points and provide a stabilizing function to the tees.

Yet still another object of the present invention is to allow a user to selectively lock the tees in a desired longitudinal position via an aperture and projection pin combination similar to the vertical locking assembly.

Yet still another object of the present invention is to allow a user to determine the distance between the first and second tees via a plurality of markings along the base.

Yet still another object of the present invention is to provide a method of utilizing the device that provides a unique means of selectively adjusting and securing the height of each tee and selectively adjusting and securing the longitudinal distance between the tees in order to provide a plurality of training configurations including parallel striking exercises, swing height exercises, and the like.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
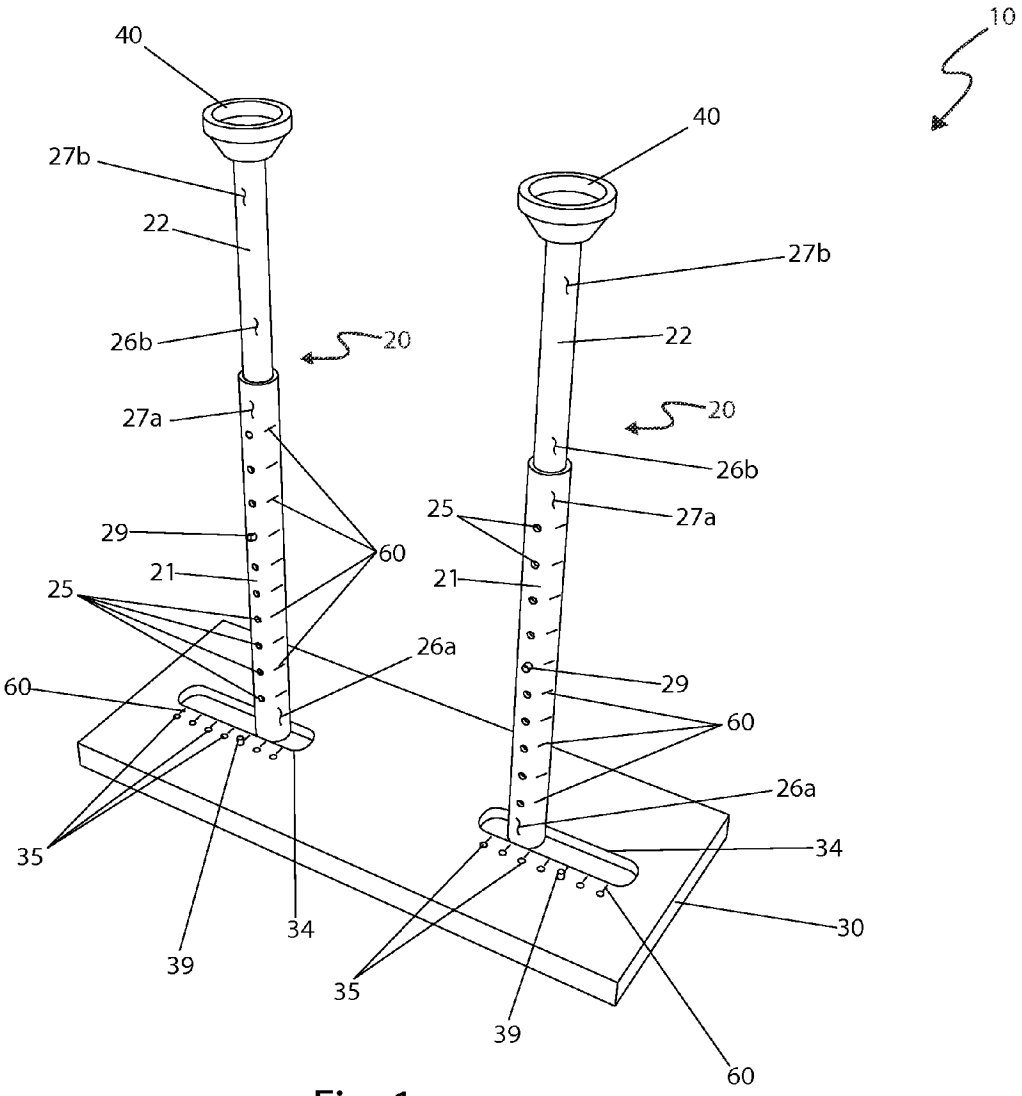
FIG. 1 is a perspective view of an adjustable batting practice tee 10, according to the preferred embodiment of the present invention.
Figure 2:
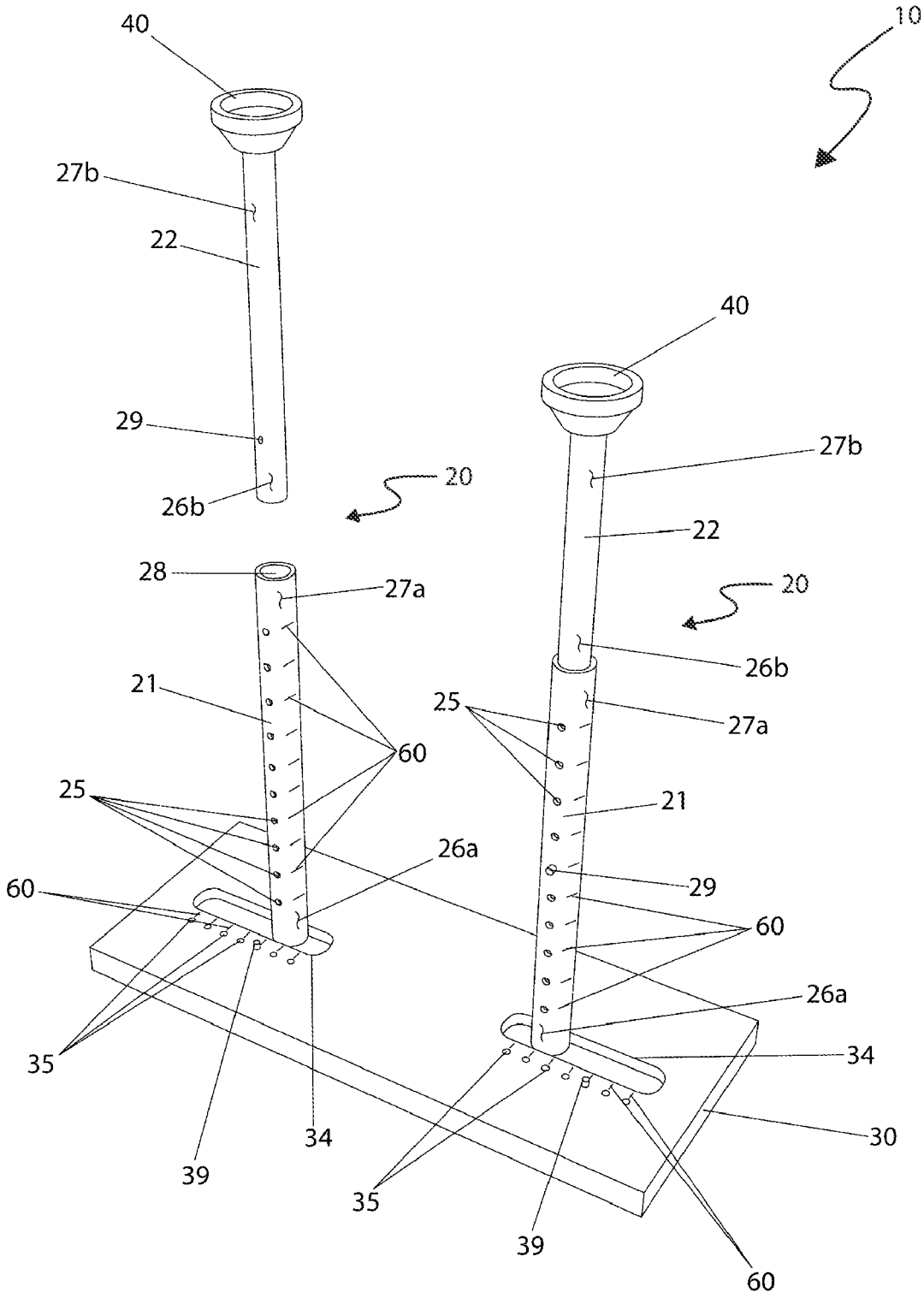
FIG. 2 is a perspective view of the adjustable batting practice tee 10 with a second extension member 22 installably removed from a first extension member 21, according to the preferred embodiment of the present invention.
Figure 3:
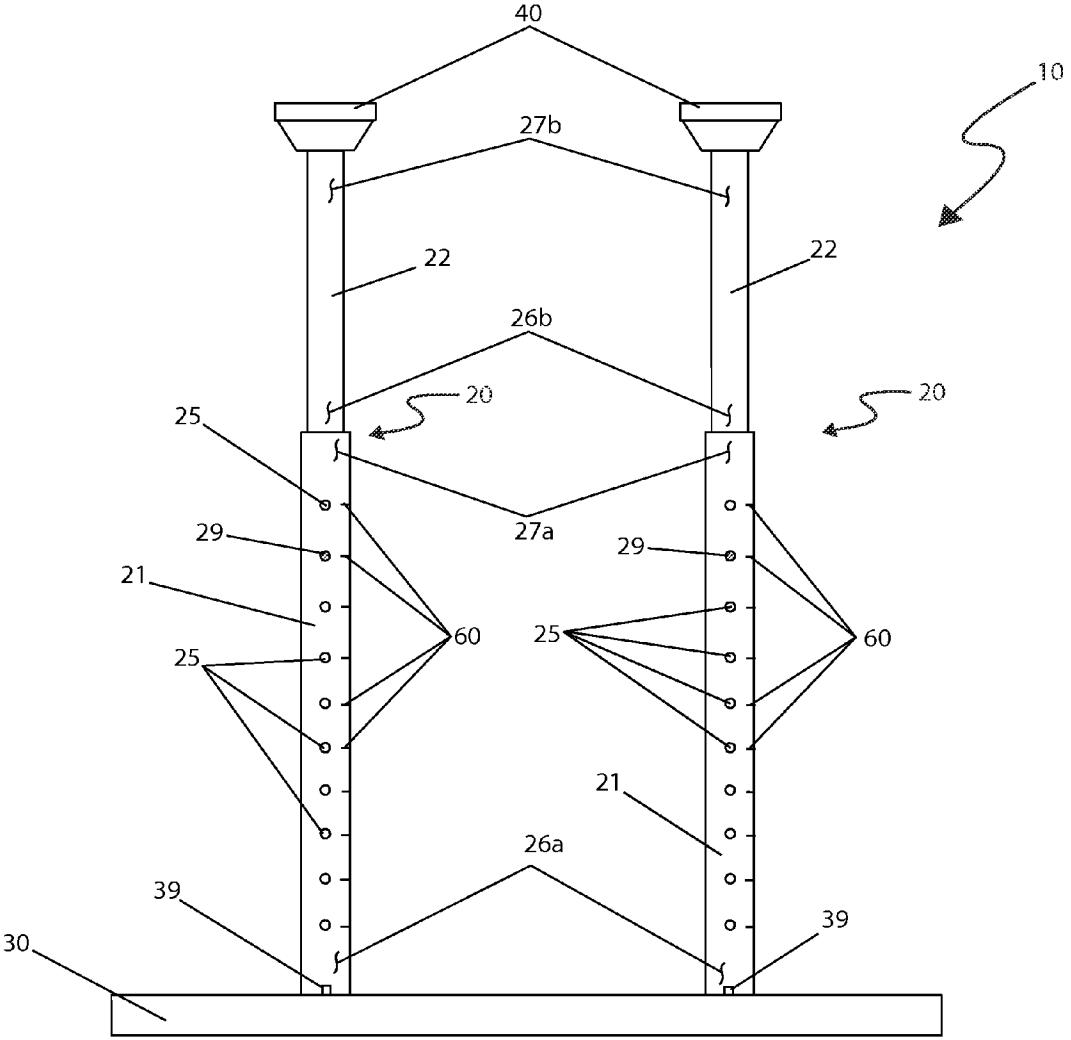
FIG. 3 is a front view of the adjustable batting practice tee 10, according to the preferred embodiment of the present invention.
Figure 4B:
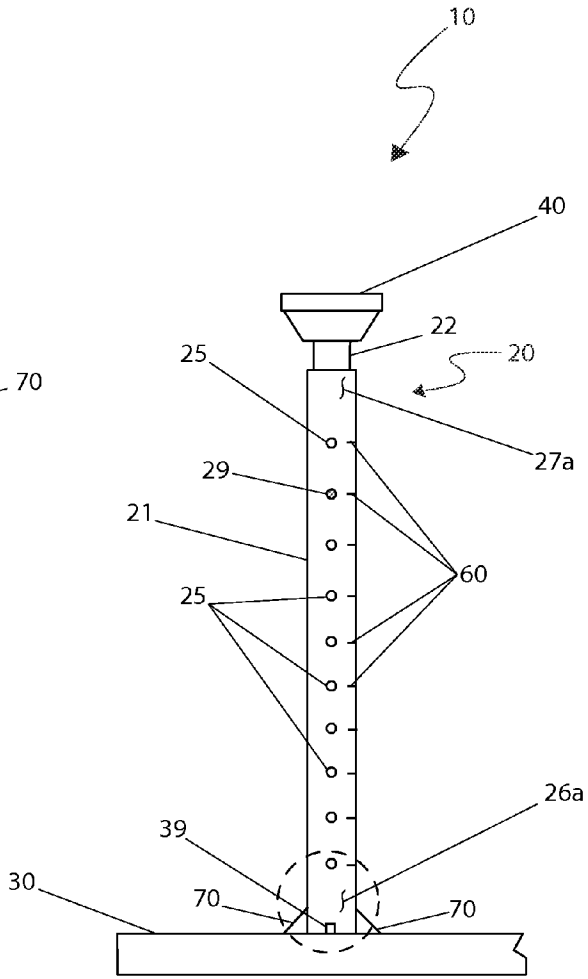
FIG. 4*b* is a blown-up inside view of the first extension member 21 with the second extension member 22 resting upon a lip 50 incorporated in said first extension member 21, according to the preferred embodiment of the present invention.
Figure 4A:
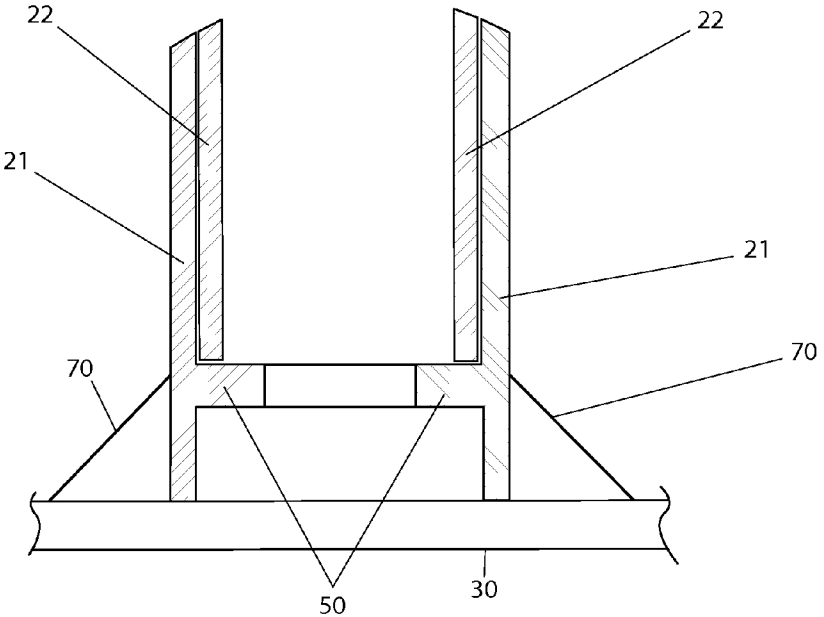
FIG. 4*a* is a side elevation view of a tee assembly 20, according to the preferred embodiment of the present invention.
Figure 4D:
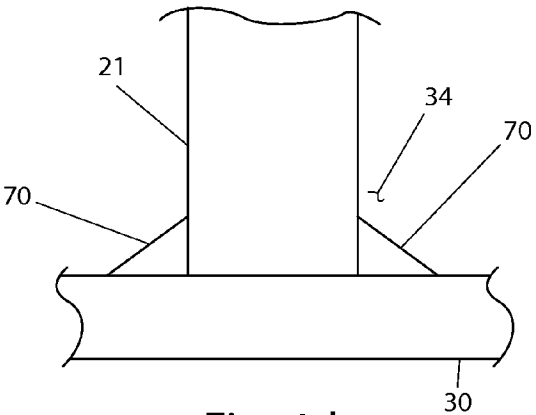
FIG. 4*d* is a blown-up inside view of the first extension member 21 installed in a slot 34 incorporated within a base 30 with ridges 70 supporting said first extension member 21, according to the preferred embodiment of the present invention.
Figure 4C:
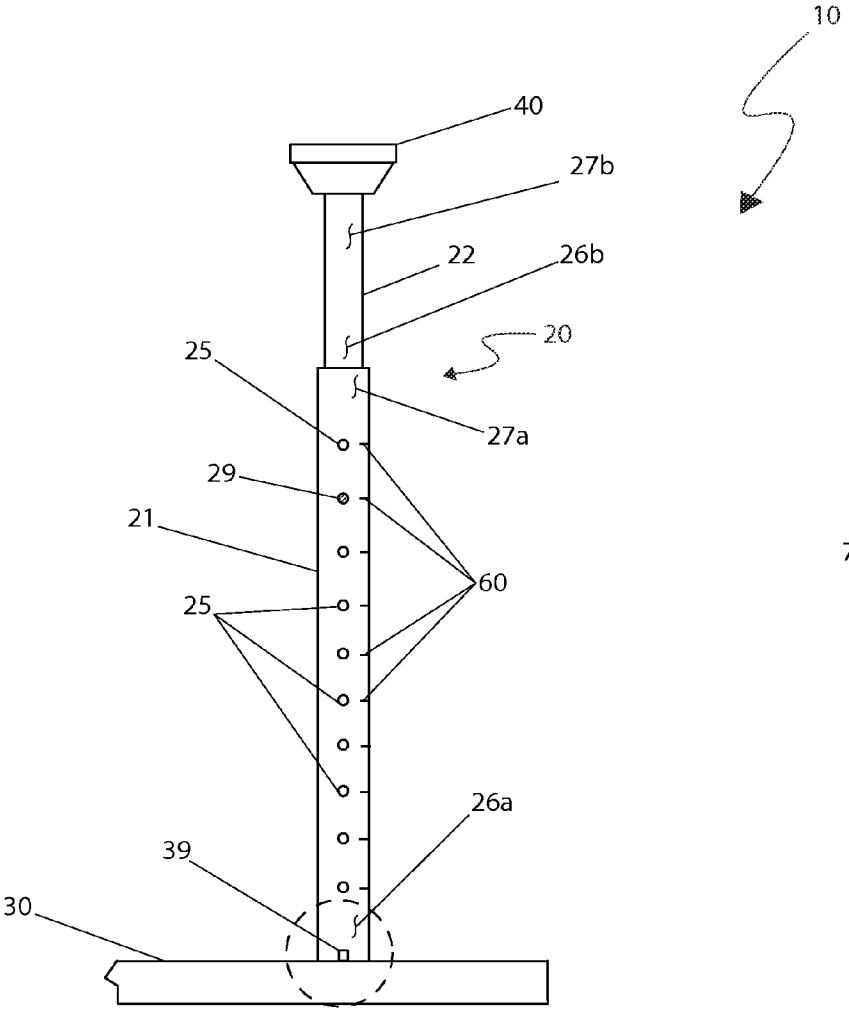
FIG. 4*c* is a side elevation view of the second extension member 22 partially extended out of the first extension member 21, according to the preferred embodiment of the present invention.

10 adjustable batting practice tee
20 tee
21 first extension member
22 second extension member
25 aperture
26*a* first distal end
26*b* second distal end
27*a* first distal end
27*b* second proximal end
28 entrance cavity
29 tee projection pin
30 base
34 slot
35 aperture
39 base projection pin
40 ball holder
50 lip
60 marking
70 ridge

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method that assists baseball and softball players to learn proper swinging techniques. The adjustable batting practice tee (herein described as the "device") 10 comprises a base 30, two (2) adjustable tees 20, and two (2) ball holders 40. Most of the various components of the device 10 are envisioned to be fabricated of one (1) or more synthetic materials, such as impact resistant plastics and/or fiberglass, in a molding or winding process and/or metals, preferably non-corrosive. The ball holders 40 are envisioned to be fabricated of a durable rubber or rubberized material being capable of withstanding thousands of impacts therefrom a rapidly moving bat.

Referring now to FIG. 1, a perspective view of the device 10 is disclosed according to the preferred embodiment of the present invention. A teaching aid device 10 that helps baseball and/or softball players learn how to properly swing and hit a ball comprising a pair of batting tees 20 that are placed on a common base 30 in a linear pattern perpendicular to the bat swing is introduced. In such a manner, the batter contacts one (1) ball and then the other during one (1) swing. An elongated base 30 is provided support for both tees 20 that is envisioned to withstand the impact that may fully or partially be inflicted thereupon either tee 20 while swinging the bat thereby preventing wobbling, swinging, and/or other undesirable motion of the tees 20 prior to, during the action of, and after swinging the bat. The base 30 is envisioned to be rectangularly formed to provide the optimum support for the tees 20, especially after being struck by a swinging bat. The base 30 is preferably fabricated of a heavy material to provide durability as well as a solid foundation to prevent undesired motion of the device 10 such as wobbling, tipping, or the like. The base 30 is shaped rectangularly to provide stability to device 10 so that anchoring of said device 10 would not be necessary. Other shapes, such as circular, oval or polygonal shapes may be used instead of the rectangular form of the preferred embodiment. The base 30 comprises a planar surface for contact with the ground surface and a planar surface to operably be facing up by which two (2) tees 20 are adjustably mounted thereto. The base 30 is envisioned to be sized to support each of the two (2) tees 20 of the device 10, as well as to provide longitudinal adjustment with regards thereto a long axis of the base 30 of said two (2) tees 20 thereof.

Referring now to FIGS. 2 through 4*d*, views of the device 10 are disclosed according to the preferred embodiment of the present invention. Adjustably fastened thereto the base 30 are two (2) vertically adjustable tees 20. It is envisioned that each tee 20 would be telescopic so that there is at least two (2) extension members 21, 22. Each extension member 21, 22 is envisioned to be tubular in a manner that said extension members 21, 22 are cylindrically formed but have a hollow center. A first extension member 21 takes the form of a cylindrical tube with a designated outer diameter and designated inner diameter. Each first extension member 21 would be adjustably mounted thereto the base 30 at the distal end 26*a*, 26*b* with the proximal end 27*a*, 27*b* vertically aligned with the distal end 26*a*, 26*b*. A second extension member 22 takes the form of a cylindrical tube with a designated outer diameter and designated inner diameter. It is envisioned that the outer diameter of the second extension member 22 to be slightly less than the inner diameter of the first extension member 21 so that said second extension member 22 may be inserted therein said first extension member 21 thus making the extension members 21, 22 collaboratively telescopic. The second extension member 22 would be slidably coupled thereto the first extension member 21 so that said second extension member 22 may motion upwardly and downwardly within said first extension member 21. A lip 50 or the like is envisioned to be formed at the lower inside diameter of the first extension member 21 so as to serve as a stop so that the distal end 26 of the second extension member 22 may rest thereupon. Such a means would prevent the second extension member 22 to be fully within the first extension member 21 and each proximal end 27*a*, 27*b* of said second extension member 22 would protrude out of the upper proximal edge of said first extension member 21. Although it has been described to have the second extension member 22 being slidably received therein the first extension member 21, let it be known that the roles could be switched so that the first extension member 21 is slidably received therein the second extension member 22, as an alternate embodiment of the present invention.

Drilled throughout the first extension member 21 is a series of apertures 25 vertically aligned along the partial length of said first extension member 21. Each aperture 25 is a designated distance apart from each other and sized to correspondingly receive a tee projection pin 29 that may be selectively inserted therein. Integrally formed on the second extension member 22 is a spring-loaded tee projection pin 29 with a diameter sized slightly less than the diameter of each aperture 25 spanned along the first extension member 21. The spring-loaded tee projection pin 29 may selectively be pushed inward to release the securement of the second extension member 22 to the first extension member 21 so that said second extension member 22 may motion freely in the vertical direction. Whenever a desired height is reached, the user may simply allow the spring-loaded tee projection pin 29 to extend through the aperture 25 corresponding to the desired height. Thus, the second extension member 22 may be adjustably raised or lowered to a designated height and then temporarily locked and stabilized into place utilizing a tee projection pin 29 inserted an aperture 25 combination.

The first extension member 21 is envisioned to have aligned apertures 25 sized to closely receive a tee projection pin 29 therethrough to lock the desired position of the second extension member 22. With the tee projection pin 29 engaged, the second extension member 22 is positioned at the desired vertical height. However, alternate temporary affixing means may be utilized for the temporary height adjustment instead of the tee projection pin 29 to aperture 25 combination. For example, a threaded screw may be inserted therein the apertures 25 in the first extension member 21 and second extension member 22 which would then be secured with a nut. Another example would be to have the first extension member 21 comprise threads that would threadingly engage a collar or the like that would tighten each proximal end 27*a* 27*b* of the first extension member 21 to the second extension member 22 and allowing a frictional force hold the designated height of the tee 20.

The first extension member 21 is envisioned to be hollow throughout the entire length of said extension member 21 with an entrance cavity 28 at the uppermost proximal edge for the insertion of each distal end 26*a*, 26*b* of the second extension member 22. Within the first extension member 21, the second extension member 22 may slide to be positioned at any desired height and secured at that height via the tee projection pin 29. Markings 60 or the like may be imprinted thereon through the full or partial length of the first extension member 21 and/or second extension member 22 with numbered insignia imprinted thereon to designate the distance. For example, markings 60 with distance insignia may be imprinted beside each aperture 25 to visually give notice to the user at which height between a ball holder 40 and the ground if that aperture 25 would have the tee projection pin 29 inserted therein.

Figure 5:
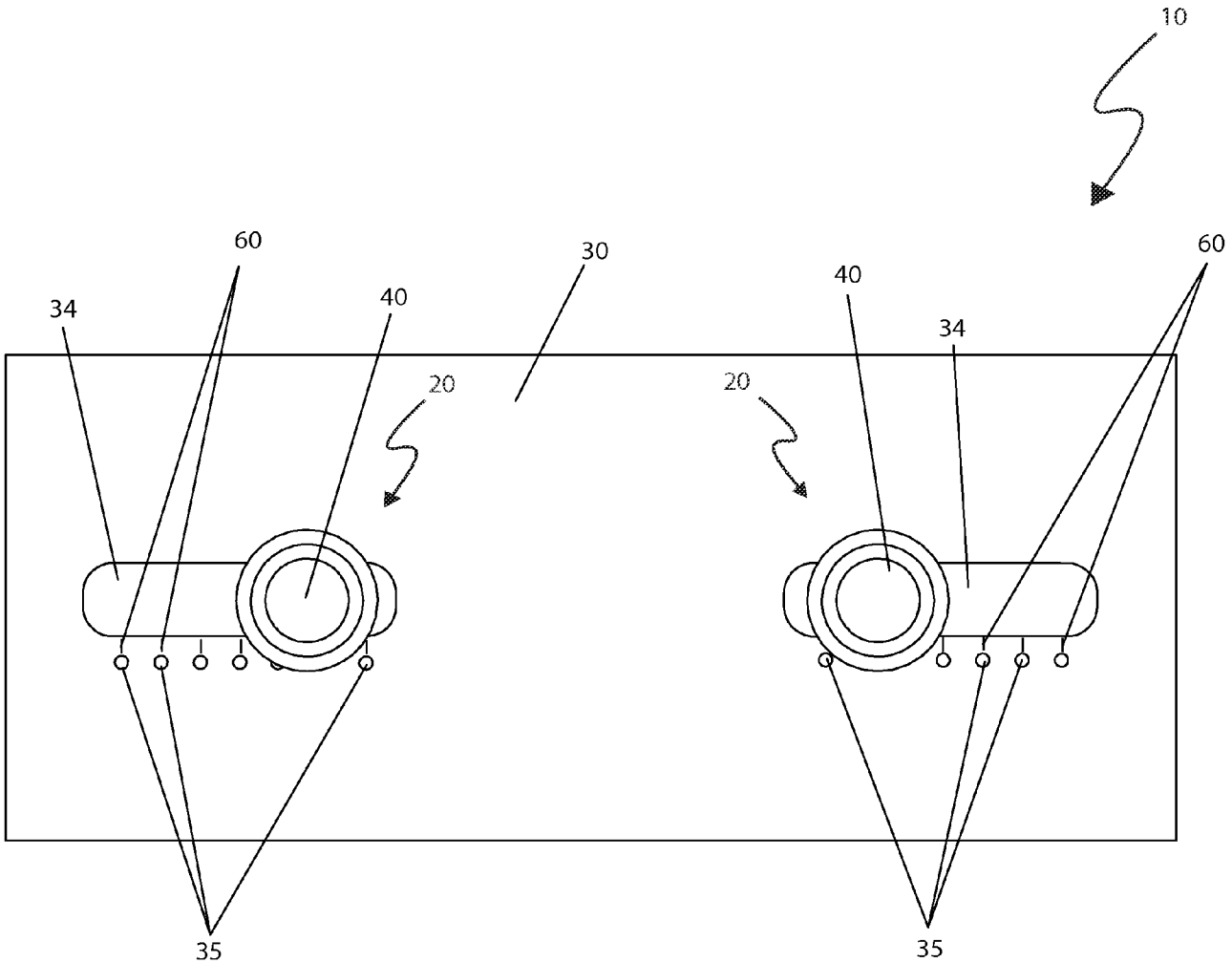
FIG. 5 is a top view of the adjustable batting practice tee 10, according to the preferred embodiment of the present invention.
Figure 6:
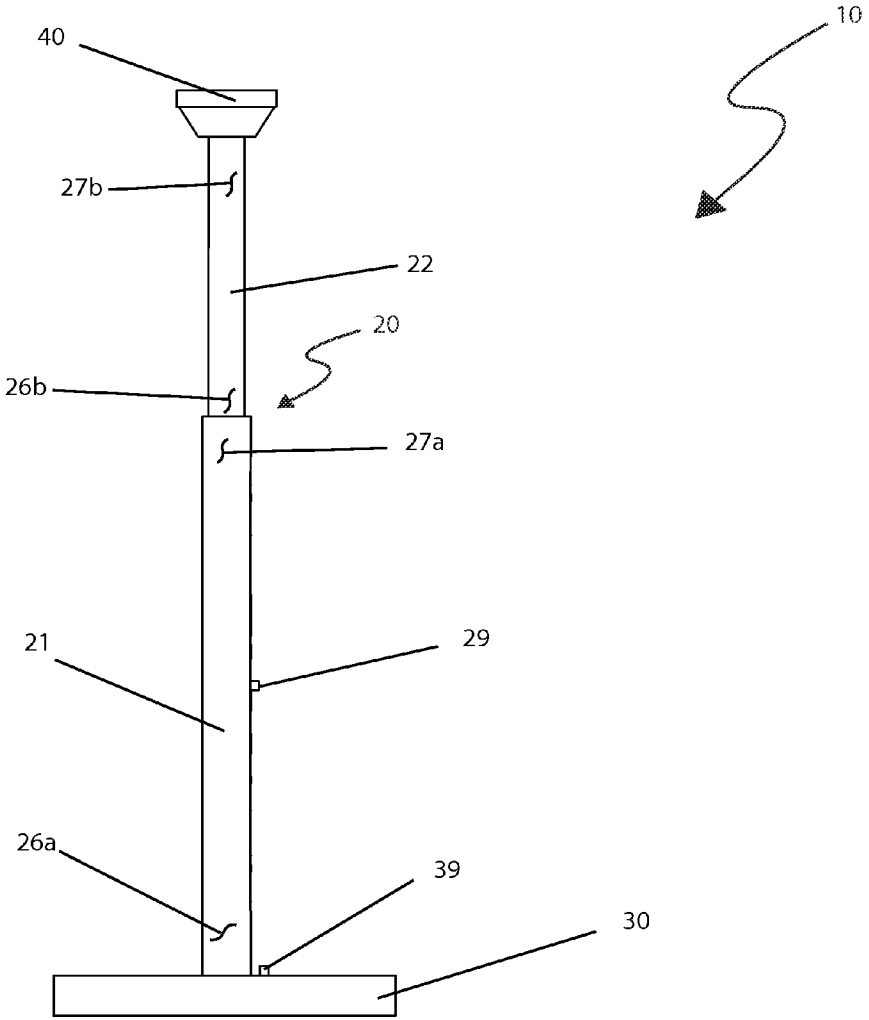
FIG. 6 is a side view of the adjustable batting practice tee 10, according to the preferred embodiment of the present invention; and, FIG. 7 is a rear view of the adjustable batting practice tee 10, according to the preferred embodiment of the present invention.
Figure 7:
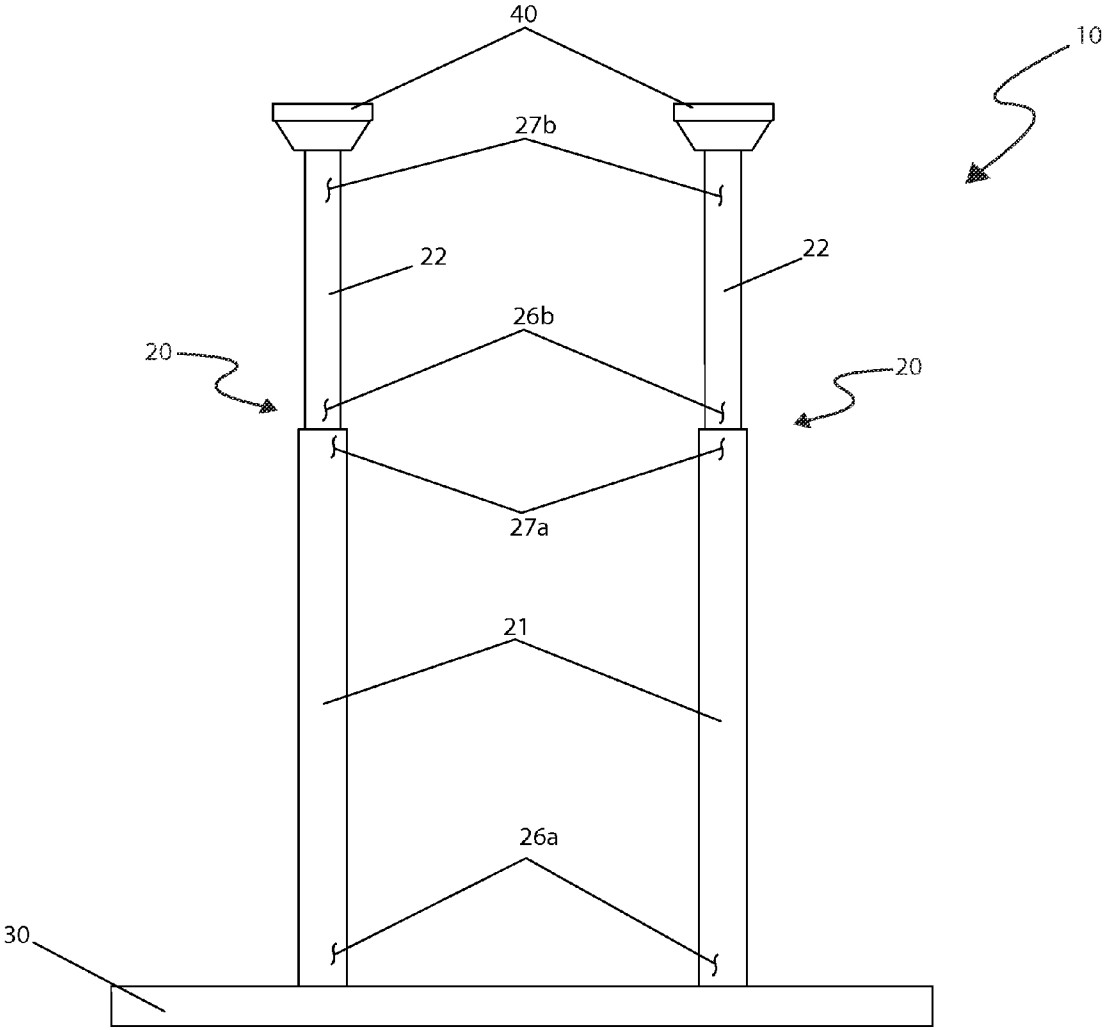

Referring now to FIGS. 5 thru 7, various views of the device 10 are disclosed according to the preferred embodiment of the present invention. A rubberized ball holder 40 is incorporated at each proximal end 27*a*, 27*b* of the second extension member 22 designed to be shaped much like a slightly concave cylinder so that the larger end of said holder 40 would be facing upwardly to contact the ball to be placed thereupon. Each ball holder 40 is designed and sized to support a ball thereon. The slightly larger end would concave downwardly to form a somewhat cup-like shape for the ball to easily rest thereupon. Further, the ball holder 40 may present a smooth surface or alternatively a surface which comprises a plurality of small spherical protrusions as to provide a frictional surface for the baseball or softball to securely rest thereupon. The rubberized ball holder 40 is envisioned to be made of soft flexible, and extremely durable rubber that will give and flex with each impact of a bat. The construction of the rubberized ball holder 40 is envisioned to be capable of withstanding nearly all force from impacts imparted by a bat while a user is attempting to hit or swing at a baseball or softball resting thereupon. Upon striking the ball holder 40, either partially or wholly, the ball holder 40 is envisioned to deflect and fold over, and then return thereto an original position, thereby retaining the same shape without any adverse affects.

The base 30 comprises a slot 34 in which the first extension member 21, and consequently the second extension member 22, of each of the two (2) tees 20 may be slidably motioned therein. Each slot 34 will be a finite length sufficient to accommodate longitudinal adjustment with regards thereto a long axis of the base 30, of each tee 20. The distal end 26*a*, 26*b* of each first extension member 21 extends therethrough each integrally formed slot 34 incorporated therein said base 30. The distal end 26*a*, 26*b* of each first extension member 21 is secured therein the slot 34 with suitable fastening means that would still allow the longitudinal adjustment with regards thereto a long axis of the base 30, of the two (2) tees 20 thereof. By adjusting these tees 20 inwardly or outwardly, the balls can be positioned closer to or farther from each other. Interior ridges 70 or the like may be integrated therein the slot 34 to promote the adherence of the first extension member 21 thereto the base 30 so that neither tee 20 would be wobbly but would rather be securely and adjustably mounted thereto the base 30. The slots 34 may further utilize these ridges 70 as stop points for the adjustable slide location. Each ridge 70 may stop the tee 20 so that said tee 20 would be in the desired longitudinal position along the base 30 and ensure that the range of longitudinal movement of either tee 20 is limited to the specified distance between each ridge 70. An appropriate amount of friction between the first extension member 21 within the slot 34 is envisioned to assist in the holding of said first extension member 21 in the relative position in accordance with the base 30, while still allowing sufficient sliding movement to occur when it is desired to motion one (1) or both batting tees 20 relative to the base 30.

The slot 34 and ridge 70 combination, securely and adjustably provides a close fit of the tee 20 to restrict movement of each distal end 26*a*, 26*b* of the tee 20 especially after each proximal end 27*a*, 27*b* of said tee 20 has been struck by a bat. Friction between the inner surface of the first extension member 21 and the outer surface of the second extension member 22 further assists to hold the relative position of second extension member 22 in accordance with said first extension member 21, especially during impact inflicted upon by a swinging bat thereon either tee 20. The ridges 70 work in coordination with the base projection pin 39 to aperture 35 combination, which will be described in detail below, to further restrict the lateral and longitudinal motion of the tee 20 prior to, during the action of, and after the action of swinging the bat so that not all restriction is relied solely on the base projection pin 39 to aperture 35 combination.

A series of apertures 25 are provided along the second extension member 22 to removably receive a releasable securement means such as the tee projection pin 29, to adjustably position and releasably secure the second extension member 22 in relation to the first extension member 21. Likewise, a series of apertures 35 are provided along the length of each slot 34 to removably receive a releasable securement means such as a base projection pin 39, to adjustably position and releasably secure the longitudinal position of each tee 20 in relation to the slot 34 incorporated therein the base 30. The base projection pin 39 is envisioned to be spring-loaded so that it may be compressed to allow longitudinal movement of each tee 20 until the base projection pin 39 engages yet another aperture 35 at the desired longitudinal location. Beside each aperture 35 may be markings 60 with distance insignia thereon to designate the longitudinal distance between the tee 20 location in cooperation with the designated aperture 35 in comparison with the front edge of the base 30, for example. By such a means, the user would know the distance between the first tee 20 and the second tee 20. Note: the figures do not distinguish between first and second tee 20 because the labeling of such is arbitrary and dependent on the view chosen. The description of first and second tee 20 is utilized for better description purposes only, and do not intend to limit the scope of the invention.

The base 30 is envisioned to have aligned apertures 35 sized to closely receive a base projection pin 39 therethrough to lock the desired longitudinal position of each tee 20. With the base projection pin 39 lightly engaged, the tee 20 is positioned longitudinally at the desired location. Alternately, any known type of releasable adjustment mechanism and/or other suitable fastening means may be used in addition to or instead of the base projection pins 39 to releasably secure the longitudinal location of each tee 20.

The tees 20 can then be moved along the slots 34 and with the combination of height adjustment possibilities of each tee 20, provides essentially an infinite number of positions for the baseball or softball with respect to the user. Thus, the device 10 can easily be utilized by any user of various size, age, shape, and skill level.

The preferred embodiment of the present invention can be utilized by the common user in a simple and effortless manner with little or no training. After initial purchase or acquisition of the device 10, it would be configured as indicated in FIGS. 1 thru 7.

The method of utilizing the device 10 may be achieved by performing the following steps: depressing the tee projection pin 29 inwardly on each of the two (2) tees 20; motioning the second extension member 22 upwardly or downwardly, as desired, to gain the desired height; securing the height of each tee 20 by allowing the tee projection pin 29 to insert into the aperture 25 which corresponds to the desired height; depressing the tee projection pin 39 inwardly on each of the two (2) slots 34 within the base 30; motioning the first extension member 21, consequently the tee 20, in a longitudinal direction forward or backward, as desired, to gain the desired longitudinal position; securing the position of each tee 20 by allowing the base projection pin 39 to insert into the aperture 35 which corresponds to the desired longitudinal position; placing the baseballs or softballs on the ball holders 40 of each tee 20; and, swinging at the baseballs or softballs on the tees 20 to get the instantaneous feedback.

The device may be utilized to perform various batting training drills. Descriptions of two (2) such drills are provided below; however, it is understood that utilization of the device 10 is not limited to those described here and as such should not be interpreted as a limiting factor of the device 10.

The method of utilizing the device 10 to teach batting follow-through and level swinging (drill #1), may be achieved by performing the following steps: aligning balls on both tees and the tees 20 at the exact same height and aligning the hitter to hit the back or rear baseball up the middle. By hitting the rear ball, and then extending through contact and hitting the front ball, the hitter immediately teaches him or herself to "get extension" through the baseball. If the hitter does not hit the front ball squarely, the device will indicate to the hitter that he or she does not "follow through" or "finish" his swing as required. If the hitter hits the back ball only, this device provides instant feedback that the swing is not level, but instead has an "upper cut" type of bat path.

The method of utilizing the device 10 to teach a downward angled swing (drill #2), may be achieved by performing the following steps: aligning a hitter to hit the front ball up the middle; positioning the front ball to be perpendicular with front foot; positioning both balls at equal height or the back ball may be slightly below the front ball to decrease difficulty for younger hitters; encouraging a hitter to swing in a slightly downwardly angled path to the front ball on a direct path from where the hands begin to the point of contact. From a side angle, the swing path appears to be slightly angled downward. A proper swing would result in only the front ball being hit. An improper swing would result in a longer, loopy swing with the back ball also being improperly struck.

To utilize the device 10, the user needs to merely lay the base 30 on the ground at the desired location. Utilize the adjustability features of the tees 20 to position the ball holders 40 level with one (1) another at the desired location in relation to the batting stance of the user. Markings 60 may be utilized to take note of the designated height at which the user will be swinging at the ball. The height distance between the ball and the ground can be easily adjusted by telescoping the second extension member 22 in or out of the first extension member 21. The second extension member 22 may be telescopically adjusted to the desired height of swing of the bat by the user. The telescoping nature of the first extension member 21 and second extension member 22 allows for the coaxial vertical adjustment of each tee 20 to fit users of various heights and size, preferably located between the knee and chest areas of said user. The distance between the batter and the first and second tee 20 is adjusted by slidably adjusting the first and second tee 20 relative to the base 30. Markings 60 may be utilized to take note of the designated longitudinal position of each tee 20 as well as the distance between each tee 20. Further, the tee and base projection pins 29, 39 to aperture 25, 35 combinations are ideal for securement position of the tees 20, as well as provide a means for easy disassembling for transportation and/or storage.

The device 10 eliminates the need to use multiple separate tees 20 to teach or practice proper swinging technique. The device 10 is described shown comprising two (2) batting tees 20 which are similar in construction that provide a wide range of height adjustment possibilities as well as distances between either and both balls and the user. Both tees 20 are envisioned to be used collaboratively to teach a user of all skill levels and age the proper swinging technique to drive a softball or baseball up the middle in a line drive motion. It is often difficult for the user to determine whether the swinging motion, as well as the follow through, are performed correctly. The two (2) tee 20 system of the device 10 is envisioned to provide instantaneous feedback to the user and/or the coach thereof whether the initial motion of the swing, as well as the follow through of the swing, is being performed correctly.

The device 10 reinforces proper swing technique, thereby limiting the down-to-up motion or popping-up the ball. Additionally, the device 10 teaches hitters to extend through contact with the ball in a desired manner. Rather, the combination of the two (2) tee 20 technique teaches the user the fundamentals of swinging level and how to directionally hit the ball where you would like the ball to travel. Because of the two (2) tee 20 structure, the user swinging the bat will gain instantaneous feedback on good hits and poor hits on each swing. With balls on both tees 20 and the tees 20 at the exact same height, the user is aligned to hit the back or rear baseball up the middle, as is desired and intention of the device 10. By hitting the rear ball, and then extending through contact and hitting the front ball, the hitter immediately gains practice to get extension through the baseball and to follow through with the swing. If the hitter does not hit the front ball squarely, the device 10 will indicate to the hitter that he or she does not follow through with the swing as desired. When the proper swing is applied, both balls will be contacted and driven in the same direction on the same line as the height of the tee 20. If the ball placed on the rear or second tee 20 is contacted but not on the front or first tee 20, then the user knows that he/she is not swinging in the desired horizontal plane and is therefore either swinging upwardly or not achieving proper extension through the ball. Thus, the device 10 teaches the user to stay on plane with the ball. Further, the two (2) tees 20 may be arranged so that the user is swinging at the front or first tee 20, which would be aligned perpendicular thereto the user's front foot.

Each tee 20 is adjustably placed to the base 30 and secured with a base projection pin 39 to aperture 35 combination, and may be adjustably positioned longitudinally in relation to the base 30, to support two (2) balls, one (1) in each tee 20, in spaced relation from the user. Each tee 20 includes a first extension member 21 and a second extension member 22. The second extension member 22 is adjustable in height in relation to the first extension member 21, and may be secured at the desired height with a tee projection pin 29 to aperture 25 combination. The combination of the vertical adjustability of the first tee 20 and second tee 20 as well as the longitudinal adjustability enable the users to position both baseballs or softballs in many different locations relative to the stance of said user. This enables users to not only practice proper swinging techniques but also apply swinging motions towards the ball at varying possible pitching locations such as low and inside or high and outside, for example. Thus, each tee 20 is adjustably positioned and heightened to the coaches or users preference, and the combination and selection of such adjustability features are helpful in the proper teaching, instruction, and learning of the proper swinging technique.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, and to thereby enable others skilled in the art to best utilize the invention and various embodiments with various modifications as are suited to the particular use contemplated.

What is claimed is:

1. An adjustable batting practice tee for assisting baseball and softball players to learn proper swinging techniques, said adjustable batting practice tee comprising:

a base adapted to rest on a ground surface, further comprising: a plurality of slots having a finite length respectively; a plurality of base projection pins;

a plurality of apertures situated along the finite lengths of each of said slots, said base projection pins being locked at desired ones of said apertures; and a plurality of markings located along a front edge of said slots;

a plurality of batting tees placed on said base, wherein said plurality of markings on said base designate a longitudinal distance between said batting tees, each of said plurality of batting tees further comprising:

a first extension member and a second extension member telescopically positioned therein; and a lip formed at a lower inside diameter of said first extension member; and a plurality of ball holders attached to said batting tees respectively;

wherein said batting tees are mounted to said base in such a manner that said batting tees remain stationary when impacted by a bat;

wherein a distal end of said first extension member is mounted to said base such that a proximal end of said first extension member is vertically aligned with a distal end of said second extension member;

wherein said distal end of said second extension member rests upon said lip such that said second extension member is prohibited from protruding out of said distal end of said first extension member; and, wherein said batting tees are linearly aligned along a central longitudinal axis of said base such that said batting tees remain in a single swing plane as a player practices a swing.

2. The adjustable batting practice tee of claim 1, wherein said first extension member further comprises:

a plurality of markings imprinted on a longitudinal length of said first extension member for indicating a height between a corresponding one of said ball holders and the ground surface; and a plurality of apertures vertically aligned and spaced apart along a partial length of said first extension member;

wherein said first extension member is hollow throughout the entire longitudinal length thereof.

3. The adjustable batting practice tee of claim 2, wherein said second extension member further comprises:

a tee projection pin; and a plurality of apertures formed along a partial length of said second extension member;

wherein corresponding pairs of said apertures of said first and second extension members removably receive said tee projection pin.

4. The adjustable batting practice tee of claim 3, wherein said ball holders are situated at said proximal ends of said second extension members respectively;

wherein each of said ball holders has a concave shape so that a larger end thereof faces upwardly and is adapted to receive a ball;

wherein said ball holders flex during impact and thereafter return to an original position.

5. The adjustable batting practice tee of claim 1, wherein said distal ends of said first extension members are slidably adjusted along said slots when said base projection pins are removed from the apertures of said slots;

wherein said slots including ridges suitably sized and shaped to longitudinally move said batting tees in linearly directions.

6. The adjustable batting practice tee of claim 5, wherein said ridges cooperate with said base projection pins to restrict respective lateral and longitudinal movement of said batting tees when impacted by the bat.

7. An adjustable batting practice tee for assisting baseball and softball players to learn proper swinging techniques, said adjustable batting practice tee comprising:

a base adapted to rest on a ground surface, further comprising: a plurality of slots having a finite length respectively; a plurality of base projection pins;

a plurality of apertures situated along the finite lengths of each of said slots, said base projection pins being locked at desired ones of said apertures; and a plurality of markings located along a front edge of said slots;

a plurality of batting tees placed on said base and extending linearly upward therefrom respectively, wherein said plurality of markings on said base designate a longitudinal distance between said batting tees; and a plurality of batting tees placed on said base and extending linearly upward therefrom respectively; and a plurality of ball holders attached to said batting tees respectively;

wherein said batting tees are mounted to said base in such a manner that said batting tees remain stationary when impacted by a bat;

wherein said base has a central longitudinal axis as well as first and second linear edges equidistantly spaced form said central longitudinal axis; and, wherein said batting tees are located at said central longitudinal axis such that each of said batting tees are equidistantly spaced in between said first and second linear edges respectively.

8. The adjustable batting practice tee of claim 7, wherein each of said batting tees comprises:

a first extension member and a second extension member telescopically positioned therein; and a lip formed at a lower inside diameter of said first extension member;

wherein a distal end of said first extension member is mounted to said base such that a proximal end of said first extension member is vertically aligned with a distal end of said second extension member;

wherein said distal end of said second extension member rests upon said lip such that said second extension member is prohibited from protruding out of said distal end of said first extension member.

9. The adjustable batting practice tee of claim 8, wherein said first extension member further comprises:

a plurality of markings imprinted on a longitudinal length of said first extension member for indicating a height between a corresponding one of said ball holders and the ground surface; and a plurality of apertures vertically aligned and spaced apart along a partial length of said first extension member;

wherein said first extension member is hollow throughout the entire longitudinal length thereof.

10. The adjustable batting practice tee of claim 9, wherein said second extension member further comprises:

a tee projection pin; and a plurality of apertures formed along a partial length of said second extension member;

wherein corresponding pairs of said apertures of said first and second extension members removably receive said tee projection pin.

11. The adjustable batting practice tee of claim 10, wherein said ball holders are situated at said proximal ends of said second extension members respectively;

wherein each of said ball holders has a concave shape so that a larger end thereof faces upwardly and is adapted to receive a ball;

wherein said ball holders flex during impact and thereafter return to an original position.

12. The adjustable batting practice tee of claim 7, wherein said distal ends of said first extension members are slidably adjusted along said slots when said base projection pins are removed from the apertures of said slots;

wherein said slots including ridges suitably sized and shaped to longitudinally move said batting tees in linearly directions.

13. The adjustable batting practice tee of claim 12, wherein said ridges cooperate with said base projection pins to restrict respective lateral and longitudinal movement of said batting tees when impacted by the bat.

14. A method of utilizing an adjustable batting practice tee for assisting baseball and softball players to learn proper swinging techniques, said method comprising the steps of:

providing and resting a base on a ground surface, said base further comprising a plurality of slots having a finite length respectively, a plurality of base projection pins, a plurality of apertures situated along the finite lengths of each of said slots, said base projection pins being locked at desired ones of said apertures and a plurality of markings located along a front edge of said slots;

providing and placing a plurality of batting tees on said base, wherein said plurality of markings of said base designates a longitudinal distance between said batting tees;

extending said batting tees linearly upward from said base;

providing and attaching a plurality of ball holders to said batting tees respectively; and mounting said batting tees to said base in such a manner that said batting tees remain stationary when impacted by a bat;

wherein each of said batting tees are linearly aligned along a central longitudinal path of said base.

* * * * *